United States Patent [19]

McCall

[11] 4,006,822

[45] Feb. 8, 1977

[54] MAILING CARTON

[76] Inventor: Richard J. McCall, 1515 North Sedgwick St., Chicago, Ill. 60610

[22] Filed: Nov. 18, 1975

[21] Appl. No.: 632,956

[52] U.S. Cl. ..... 206/424; 229/34 HW; 229/40

[51] Int. Cl.[2] ..... B65D 85/30

[58] Field of Search ..... 229/34 HW, 40, 14 C; 206/424, 521

[56] References Cited

UNITED STATES PATENTS

| | | | |
|---|---|---|---|
| 2,709,032 | 5/1955 | Ritchie | 229/14 C X |
| 2,770,410 | 11/1956 | Williamson | 229/34 HW |
| 3,162,351 | 12/1964 | Rudofski | 229/14 C X |
| 3,516,593 | 6/1970 | Larsen | 206/424 X |
| 3,712,531 | 1/1973 | McCall | 206/424 X |
| 3,768,721 | 10/1973 | Carpenter et al. | 229/40 |

*Primary Examiner*—Stephen P. Garbe
*Attorney, Agent, or Firm*—Hill, Gross, Simpson, Van Santen, Steadman, Chiara & Simpson

[57] ABSTRACT

A one-piece foldable corrugated mailer container has a one-piece blank which upon assembly into a box defines a pair of longitudinally spaced double-triangular side wall abutments and air pockets for bottoming and protecting the side edges of a weighty object such as a heavy book contained therein during shipment and for holding and locking the object in fixed position away from the side edges of the folder. A portion of the side wall abutment extends inwardly from each respective side to underlie the article or object contained thereby to assist in securing the blank into its double-triangular pocket configuration.

1 Claim, 4 Drawing Figures

MAILING CARTON

BACKGROUND OF THE INVENTION

1. Field of the Invention

This invention relates to one-piece foldable boxes and more particularly to a foldable corrugated mailer container.

2. The Prior Art

The state of the prior art is well represented by my earlier issued U.S. Pat. Nos. 3,426,957 and 3,712,531. In 3,426,957 there was provided a blank foldable into a mailer particularly characterized by a three-sided air pocket at the opposite respective ends of the container to protect the corresponding ends of the article within the container. In U.S. Pat. No. 3,712,531 there was provided a reinforced air pocket characterized by a locked triangular-like side wall construction.

SUMMARY OF THE INVENTION

The present invention constitutes a further improvement which is particularly suitable for mailing heavy articles or objects such as a cook book or an encyclopedia. The carton is characterized by a simple one-piece blank scored and folded to provide an easily assembleable container having a triangular or prismatic, reinforced end wall pocket construction. Each pocket has a vertical wall forming an abutment surface for resisting forces directed against the end edges of the container. The pocket additionally has a lower horizontal wall disposed adjacently contiguous to the main wall of the container and an angularly inclined wall extending between the vertical and the horizontal walls to form an air pocket which is generally triangular in cross section. A cut-out or struckout portion in the vertical wall extends inwardly from each respective vertical wall to underlie the article contained within the mailer, thereby securing the box and the article in integral assembled relation.

DESCRIPTION OF THE PREFERRED EMBODIMENTS

Figure 2:
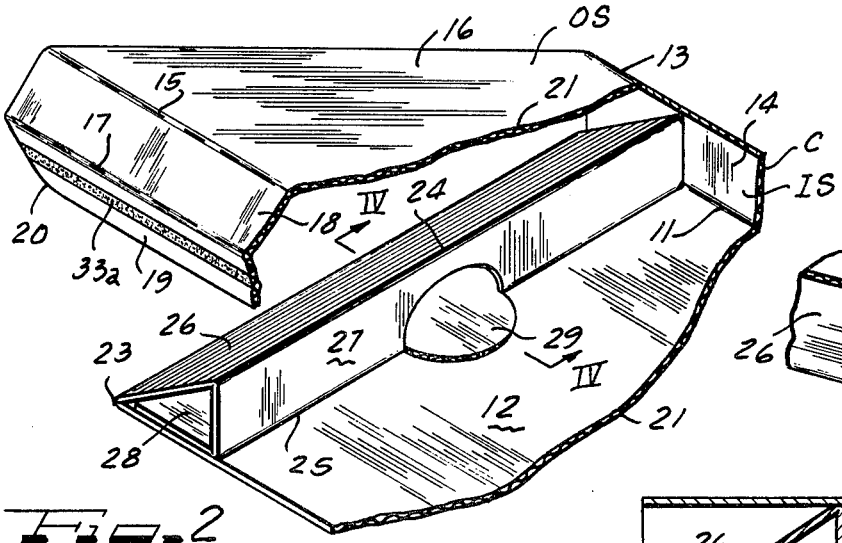
FIG. 2 is a sectional perspective view of a carton in an advanced stage of assembly.

While the box of the present invention may be made of any suitable paper or composition material an exemplary construction is herein disclosed as comprising a sheet form member such as a double faced sheet of corrugated paper indicated generally at 10 and having a laminated construction consisting of a corrugated core C with double faces provided by an inside surface sheet IS and an outside surface sheet OS (FIG. 2). The outside surface sheet OS forms a smooth display surface suitable for having imprinted thereon or affixed thereto any desired indicia such as postal fee information and return address.

Figure 1:
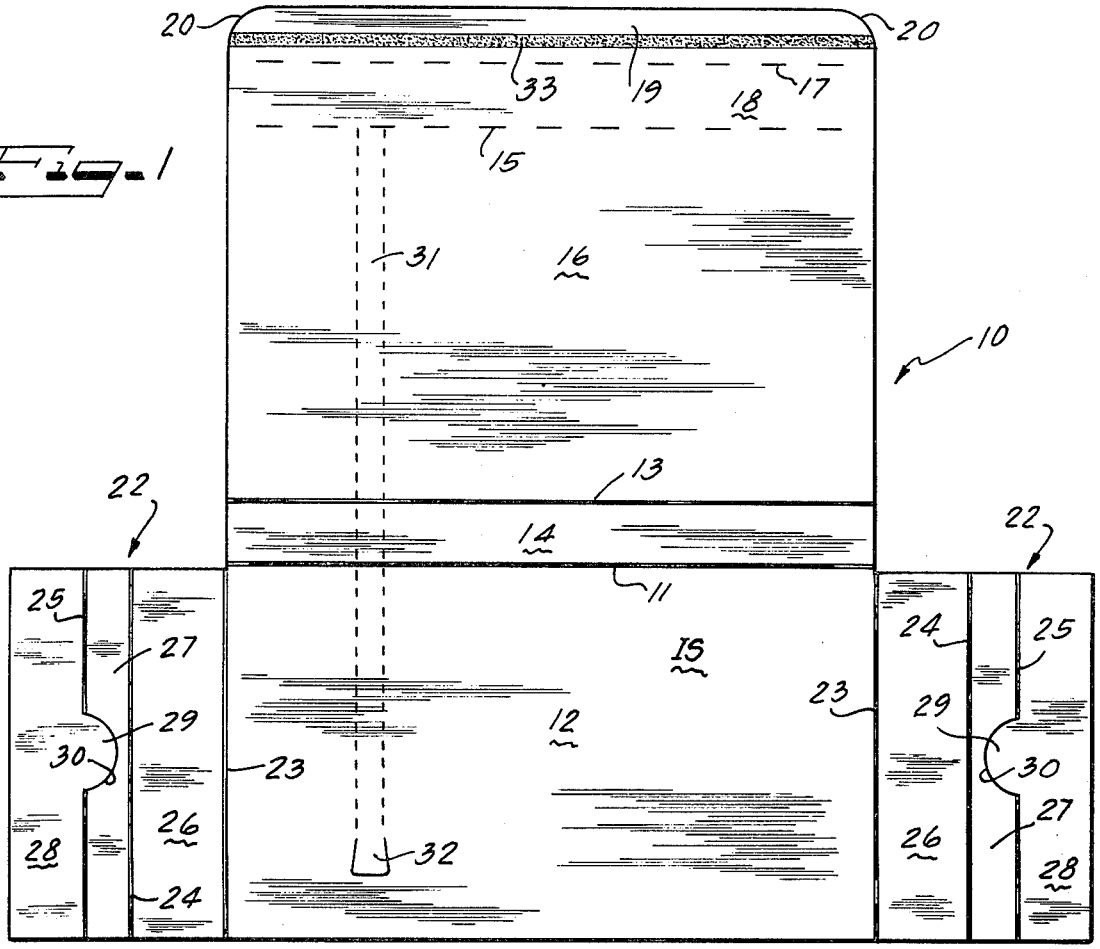
FIG. 1 is a plan view of a blank of corrugated sheet material cut and scored in accordance with the invention.

In accordance with the principles of the present invention, a die cutting process is carried out to afford substantially simultaneous cutting and scoring operations. Thus, the blank 10 is not only cut to proper peripheral configuration as shown in FIG. 1 but the desired cut lines are formed in the blank, as well as the proper scoring lines to divide the blank into a plurality of panels. The box of the present invention is strengthened if the corrugations are aligned to run parallel to four principal score lines 11, 13, 15, and 17 provided on the body portion of the blank. Such configuration contributes to the ease with which the box may be folded into an assembled condition and also contributes to the overall strength of the box.

The sheet form member 10 comprises a main body portion having a first score line 11, thereby forming a bottom wall portion 12. A second score line 13 is formed in the body portion in spaced relation to score line 11, forming a rear wall portion 14. A further score line 15 spaced from the score line 13 formed a third panel adjacent the rear wall 14, which is substantially the same size as the bottom wall 12, comprising a top wall 16. A fourth score line 17 is formed in the body portion in spaced relation to score line 15, thereby forming a front wall 18 of substantially the same dimensions as the rear wall 14. A remaining fifth panel in the body portion forms a closing flap 19, which conveniently has rounded corners as at 20. The scores or score lines 11, 13, 15 and 17 extend longitudinally, coextensively with corrugations 21, to provide added strength at the peripheral, side edge portions of the assembled mailing folder.

The box of the present invention is particularly characterized by the provision of a distinctive flap construction on each side of the bottom wall 12 which differs in important respects from the corresponding located flaps in my earlier issued U.S. Pat. Nos. 3,426,957 and 3,712,531. Thus, it will be noted that there is designated generally at each end of the bottom wall 12 a three-panel side member 22, 22. The blank 10 is provided with transverse score lines 23, 24 and 25 on either side of the bottom wall 12 which form integral hinge connections between respective first, second and third side flap members 26, 27 and 28 and the bottom wall 12. The spacing dimension or width between score lines 24 and 25, forming a second flap member 27, is substantially two thicknesses of corrugated material 10 less than the spacing dimension between the score lines 15 and 17 or 11 and 13. This relation of spacing dimensions between score lines 24-25, 15-7 and 11-13 allows formation of a box that is substantially rectangular in shape despite portions of the assembled box having differing thicknesses of corrugated stock.

There is thus provided a foldable end flap on each end which includes a first component extending upwardly and inwardly at approximately a 30° to 40° angle. The folding flap then extends at a 90° angle to the main body flap and has reentrant portion which extends outwardly in parallel adjacency to the main body flap.

Also, in accordance with the principles of the invention, a tab 29 is provided extending from the third side flap member 28, the material for the tab 29 being cut from the second flap member 27 along a cut line 30 so that the tab is disposed to extend inwardly in contiguous adjacency to the bottom wall 12. The score line 25 does not extend across the tab 29 at its juncture with the flap 28, but rather the tab 29 will remain co-planar with the third flap 28 even when the flaps 27 and 28 are folded with respect to one another. The tab 29 is adapted to be captured between an object placed within the box during assembly and the bottom wall 12 of the box, thereby maintaining the side members in proper configuration during assembly of the box. In this form of the invention the tab 29 is shaped in a semi-circular configuration. However, the tab 29 could be made in other geometric configurations if desired.

A perforated tear strip 31 is provided along a portion of the blank 10 to facilitate opening of the assembled and sealed carton. The tear strip 31 extends from approximately the portion of score line 15, across the top and rear walls 16 and 14 respectively and terminates in a lift-tab 32 positioned in a front portion of the bottom wall 12. Other arrangements such as strong tear-tape may also be provided.

An adhesive or glue line 33 extending substantially across the center of the closing flap 19 on its inner side is provided as in FIG. 1 to form a sealing means for the assembled box when the closing flap 19 is disposed to overlie the adjoining outside surface of the bottom wall 12. It should be understood that the principles of the present invention could be practiced with other closing flap arrangements, for example, if the flap 19 were disposed to be tucked in. For example, a glue line 33a could be provided on an outer face of the closing flap 19 as shown in FIG. 2. It would also be possible to alter the shape of the closing flap 19 and close the container with a sealing tape.

Figure 3:
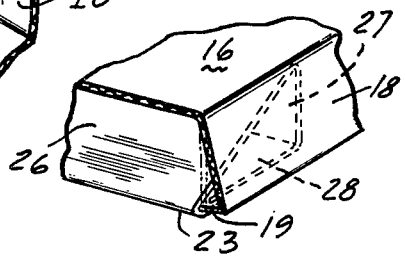
FIG. 3 is a perspective view of an end portion of a carton assembly of which is nearly complete.
Figure 4:
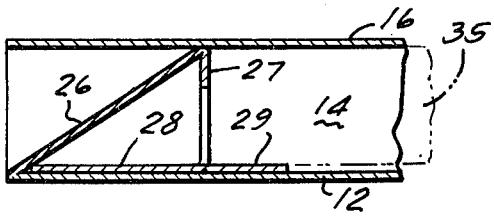
FIG. 4 is a fragmentary cross-sectional view taken on the plane of line IV—IV of FIG. 2 but showing a completely assembled container.

In assembling the box substantially as illustrated in FIGS. 2 and 3, the three-panelled side members 22 including flaps 26, 27, and 28 are first folded into a right prism against the inside surface 15 of the bottom wall 12. Each flap 27 forms a vertical abutment wall normal to the wall 12. The third flap 28 will overlie the bottom wall 12 and form a double reinforced portion with the first flap 26 forming the hypotenuse of a right triangle, a shown in FIGS. 2 and 4. The tabs extend toward one another within the rectangular space formed by the bottom wall 12 and side walls comprising the second flap members 27, 27. The bottom or other article or object 35 to be contained within the box is placed upon the bottom wall 12, between the side members 27 and overlying the tabs 29 to lock the right prisms into proper assembled configuration, as in FIG. 4 and to assist in holding the article or object in an integral assembled condition with the mailer.

Next, the body portion including the top wall is folded upwardly along the score line 11 to a position perpendicular to the bottom wall 12. Continued movement of the top wall 16 folds the blank 10 along the score line 13 until the top wall 16 is parallel to and overlying the bottom wall 12 and the rear wall 14 is perpendicular to both. Then the closing flap 19 is brought into engagement with the bottom wall 12 by making folds at the score lines 15 and 17. If a glue line 33a has been placed upon an outside face of the flap 19, the flap 19 will be inserted inside the box between the book or other object 35 enclosed and the bottom wall 12. If a glue line 33 is placed on an inside surface of the closing flap 19, the flap 19 is folded beneath the bottom wall 12 and engaged with the outer or bottom surface thereof.

Such sequential folding process produces a box or carton wherein the sides of the book or other enclosed object 35 are protected by at least one thickness of corrugated material. The top and bottom edge portions are protected against injury by the pair of right-triangular or right-prism structures having a vertical abutment wall bulwarked by multiple panels of end-grain corrugations for resisting end-wise loads, shocks, and impacts. These double-prism air cells provide exceptional safety for the contents of the box-like mailer folder since they allow relatively negligent or rough handling thereof without concern as to content damage. The corrugations present substantially rigid end portions which are not easily bendable or otherwise damaged.

Although various minor modifications will be apparent to those skilled in the art, it should be understood that I wish to embody within the scope of the patent warranted hereon all such modifications as reasonably and properly come within the scope and spirit of my contribution to the art.

I claim as my invention:

1. A mailer carton formed from a one-piece blank, the blank being T-shaped and having substantially parallel first fold lines forming and hingedly connecting bottom, rear, top, and front walls and having parallel second fold lines disposed perpendicularly to said first fold lines to form side members hingedly connected to said bottom wall, the second fold lines forming first, second, and third side flaps, said carton being substantially rectangular, having an enclosed chamber for receiving a heavy article, and comprising:

bottom, rear, top, and front walls enclosing said chamber on four sides; and a pair of side members enclosing said chamber on opposite ends thereof, each of said members forming a protective air pocket therewithin which is triangular in cross-section, and each of said side members comprising:

a first inclined side flap connected to said bottom wall and extending inwardly and upwardly thereof to engage against said top wall, a second, vertical side flap extending from said first inclined flap to said bottom wall and from said front to said rear wall, a third, sidewardly extending side flap connected to said second side flap and extending outwardly from said second side flap, an edge of said third side flap engaging an inside surface of said first, inclined side flap, and a horizontal tab affixed to said third flap and severed from said second flap, said tab being positioned to overlie the bottom wall of the carton to be captured beneath the heavy article; whereby said first and third flaps reinforce said second, vertical side flap independently of the rest of the carton to support the article protectively between the opposite vertical flaps of said side members spaced inwardly of said side edges of said top and bottom walls.

* * * * *